US006042386A

United States Patent [19]

Cohen et al.

[11] Patent Number: 6,042,386

[45] Date of Patent: Mar. 28, 2000

[54] SURFACE MOUNTED ELECTRICAL CONNECTOR

[75] Inventors: Thomas S. Cohen, New Boston, N.H.; Mark W. Gailus, Somerville, Mass.

[73] Assignee: Teradyne, Inc., Boston, Mass.

[21] Appl. No.: 09/156,227

[22] Filed: Sep. 18, 1998

Related U.S. Application Data

[62] Division of application No. 08/454,898, May 31, 1995.

[51] Int. Cl.[7] ..... H01R 9/09

[52] U.S. Cl. ..... 439/60; 439/606; 439/108

[58] Field of Search ..... 439/60, 62, 65, 439/108, 634–637, 606

[56] References Cited

U.S. PATENT DOCUMENTS

| | | | |
|---|---|---|---|
| 4,795,374 | 1/1989 | Rishworth et al. | 439/634 |
| 4,904,197 | 2/1990 | Cabourne | 439/637 |
| 4,909,743 | 3/1990 | Johnson et al. | 439/60 |
| 4,932,885 | 6/1990 | Scholz | 439/60 |
| 5,052,936 | 10/1991 | Biechler et al. | 439/60 |
| 5,098,311 | 3/1992 | Roath et al. | 439/74 |
| 5,127,839 | 7/1992 | Korsunsky et al. | 439/108 |

*Primary Examiner*—Steven L. Stephan
*Assistant Examiner*—T C Patel

[57] ABSTRACT

A high speed, high density surface mount connector which may be easily manufactured. The connector is formed by injection molding a ground plate into a portion of an insulative housing, leaving conducting beam portions and tail portions extending from opposite ends of the housing. A mating section of the housing is separately made. Signal contacts are sandwiched between the two pieces of the housing, which are then mated. The signal contacts are parallel to the ground plate but spaced apart from it, forming individual transmission lines. In use, the tail portions are soldered to a printed circuit board. The beam portions are bent to form contact springs. They make contact to a back plane when the connector is pressed against the back plane.

31 Claims, 4 Drawing Sheets

SURFACE MOUNTED ELECTRICAL CONNECTOR

This application is a division of application Ser. No. 08/454,898, filed May 31, 1995.

This invention relates generally to connectors for routing signals between circuit boards and more specifically to high speed and high density connectors.

Electrical connectors are widely used in modern electronic equipment. Sometimes, many printed circuit boards are connected together through a "back plane." For example, many computers are assembled in this fashion. The connectors are made in two pieces and may easily mated or unmated. The connectors make the assembly and maintenance of the electronic equipment easier. The circuit cards plugged into the back plane are called "daughter cards."

In other instances, circuit boards are connected together another than through a back plane. Connectors like those used on a back plane can be used in this instance. The shape of the tail portions of the connector contacts might be different to facilitate parallel mounting of the two circuit boards. When two boards are connected in this fashion, one is called the "motherboard" and one is called the daughter card." However, because similar connectors can be used in either application, as used herein, the term "back plane" or "back plane connector" will refer generically to either.

Early "card edge" back plane connectors had plastic housings with rows of conductive contacts along either side of a slot down the middle. The daughter card had contact pads along one edge. That edge of the card was plugged into the back plane connector. The conductive contacts were spring biased against the contact pads on the daughter card, completing conductive paths between the two boards.

Two piece connectors have become more prevalent. With two piece connectors, a plastic housing is mounted on each circuit board to be joined. Each housing has numerous conductive contacts in it. When the two housing are mated, the conductive contacts in each housing touch, making electrical contact. Usually, some sort of spring force is used to keep the contacts together. Many connectors of this type have one set of contacts shaped as pins with the other set of contacts shaped as receptacles into which the pins can be inserted. However, other types of contacts have been used. For example, fork and blade contacts have also been used.

Ordinarily, two piece connectors contain many rows of contacts. Tails of the contacts extend from the housing and are attached to the printed circuit boards. In this way, numerous signals can be carried between the two boards.

A refinement on the two piece connector has been the use of ground plates between adjacent rows of the signal contacts. Some connectors have the ground plates between the contact areas. Examples of this type of connector are U.S. Pat. Nos. 4,571,014, 4,975,084, 4,846,727 and 5,403,206. Other connectors have the ground plates between the tails. Examples of this type of connector may be found in U.S. Pat. Nos. 4,898,546, 5,055,069 and 5,135,405.

Depending on their shape and placement, ground plates can serve one or more different functions. Some reduce crosstalk. Others lower distortion by providing a low impedance ground. Yet others are primarily intended to reduce electromagnetic radiation from the connector.

Another refinement in two piece connectors is having the tails of the contacts formed on circuit boards. One side of the circuit board contains a ground sheet. Traces forming the signal paths for the tails are disposed on the other side, forming a transmission line on the board.

Flex circuits are also sometimes used to connect points on a printed circuit board. Flex circuits contain numerous parallel conductive traces on a flexible substrate. Some such circuits include a grounded backing so that each trace acts as a transmission line. Each trace ends in a conductive pad and connection is made to a printed circuit board by pressing the conductive pads on the traces into conductive pads on the printed circuit board. Connectors which make contact through pressure are sometimes called "pressure mounted" contacts. Spring beam members have also been used to make pressure mounted contacts. However, when spring beams are used, the connector is fixed to the printed circuit board and is not removable in normal use.

Another refinement is called an "active connector." An active connector is a connector which incorporates circuit elements into the connector. One such connector uses flex circuit attached to a conventional pin and socket type connector. A circuit element is attached to the flex circuit and makes contact to some of the traces in the flex connector.

Though there are many types of connectors available, it would be desirable to have a connector with a precisely controlled impedance to reduce signal reflections. It would also be desirable to have a connector which could accommodate fast signals, those with rise times on the order of 250 psec or less. Such a connector should also be durable while at the same time being detachable so that printed circuit boards can be joined and separated during use. It would also be desirable if such a connector could incorporate active elements without the need for additional flex circuitry.

SUMMARY OF THE INVENTION

With the foregoing background in mind, it is an object of the invention to provide a high density, high speed circuit board connector.

It is also an object to provide a circuit board connector with a controlled impedance.

It is also an object to provide a durable, detachable connector.

It is also an object to provide a connector which can support active elements.

The foregoing and other objects are achieved in a circuit board connector having an insulative housing. Signal contacts extend from one surface of the housing and are attached to a first circuit board. Within the housing, the signal contacts run parallel to ground conductors, forming a transmission line. The signal contacts extend from another surface of the housing and are bent to form spring contacts. The connector is mounted to a second printed circuit board with the spring contacts touching signal contact pads, thereby completing signal paths between the first and second circuit boards.

In one embodiment, the signal contacts are between the ground contacts and the outer surface of the housing. The housing includes a cavity which exposes some of the signal contacts. These signal contacts are interrupted, and include contact pads. A circuit element is then inserted into the cavity and makes contact to the contact pads on the signal conductors. In this way, signals are electrically processed as they pass through the connector.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
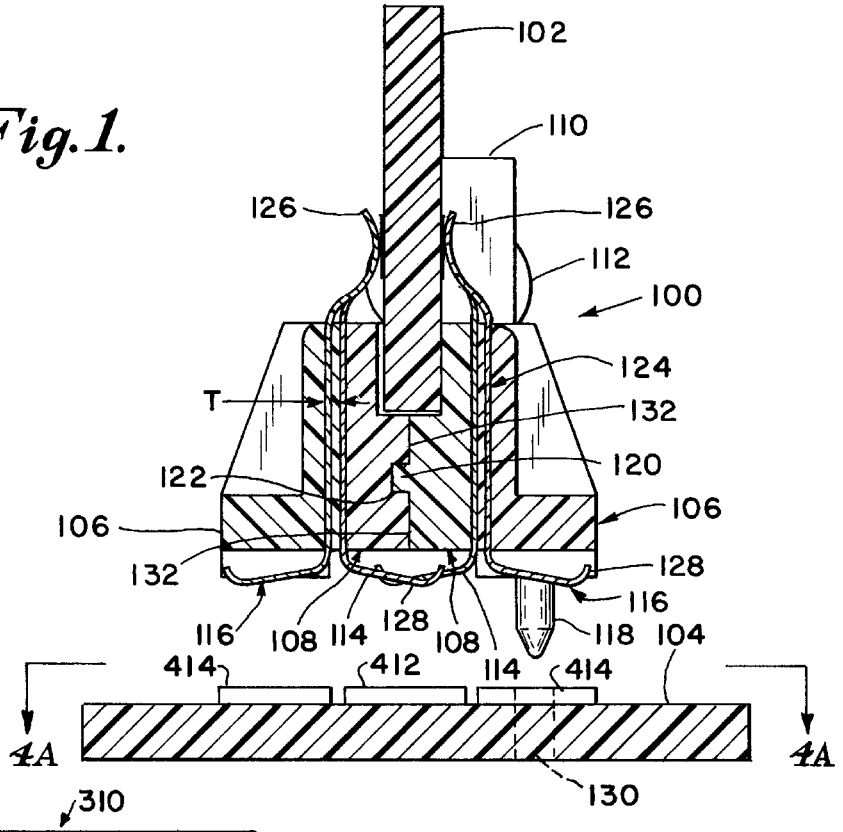
FIG. 1 shows in cross section the connector of the invention.

FIG. 1 shows connector 100 in cross section. Connector 100 is attached to a printed circuit board 102. Such a printed circuit board is sometimes called a daughter board. Connector 100 attaches to back plane 104. Generally, a back plane is also a printed circuit board to which other printed circuit boards are connected. Connector 100 carries signals between back plane 104 and printed circuit board 102.

Connector 100 is made in two halves which are identical in the preferred embodiment. The halves are mounted to opposite sides of printed circuit board 102.

Each half of connector 100 contains a housing 106. Housing 106 is made of an insulative material. Preferably it is injected molded from plastic or polyester.

Each half of connector 100 also contains ground insert 108. Ground insert 108 is made of an insulative material, also preferably injection molded. It has embedded therein ground conductors 114. The ground conductors are covered by the insulative material with a thickness T. Ground insert 108 is shaped to mate with housing 106.

Ground conductors 114 extend from each side of ground insert 108. Solder tails 126 extend from the upper side and are bent to contact printed circuit board 102. Beam portions 128 extend from the lower surface and are bent to form a beam contact. When connector 100 is pressed against back plane 104, beam portions 116 will press against back plane 104.

Figure 2:
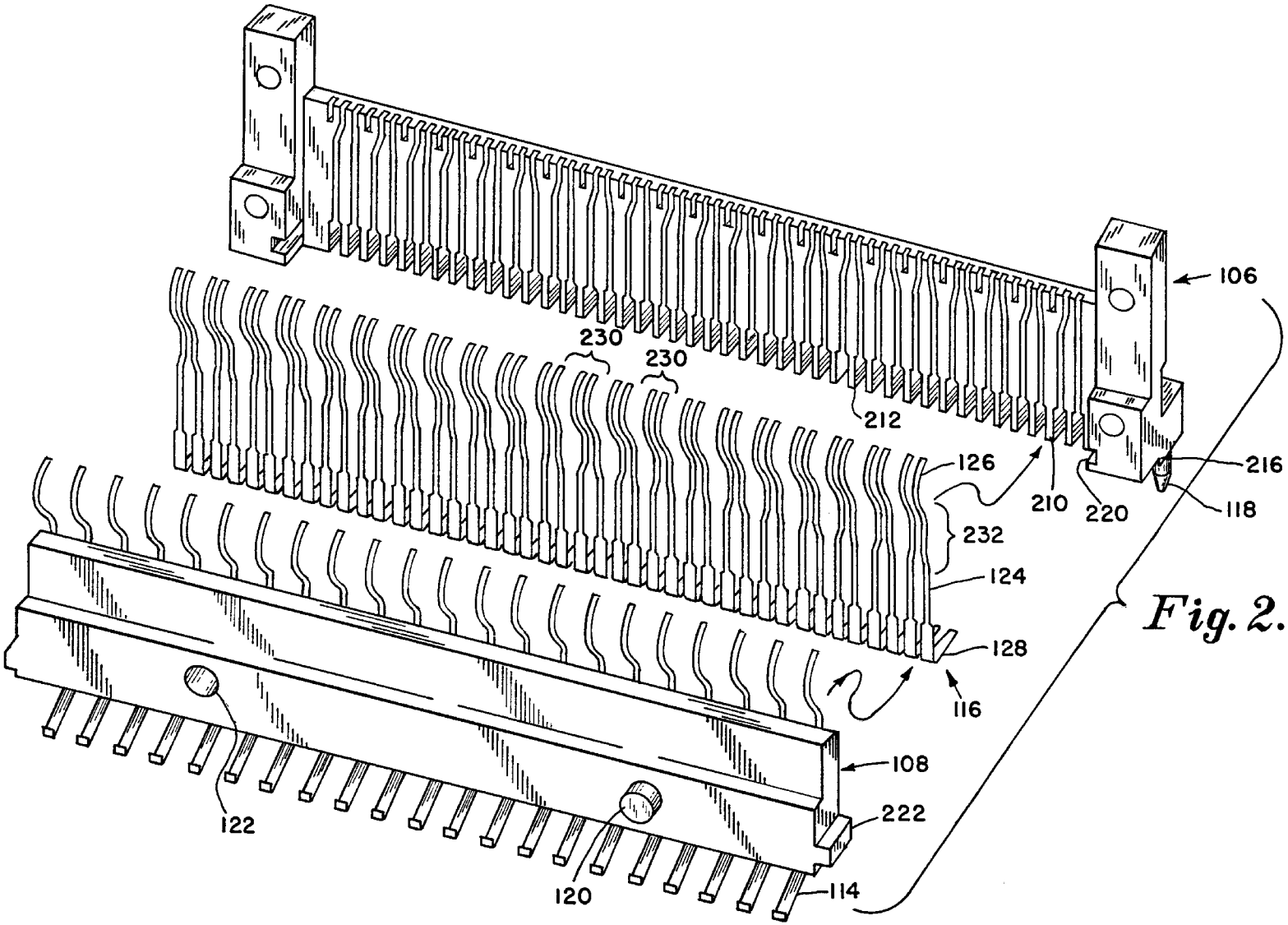
FIG. 2 is an exploded view of one side of the connector of FIG. 1.

Housing 106 contains numerous parallel slots 212 (FIG. 2). Signal conductors 116 fit into slots 212. Signal conductors 116 also contain solder tails 126 which extend from the upper surface of housing 106 and beam portions 128 which extend from the lower surface of housing 106.

Within housing 106, signal contacts run parallel to ground contacts 114. They are spaced apart by the distance T and form what is electrically equivalent to a transmission line.

To ensure proper alignment of the two halves of connector 100, ground inserts 108 contain pins 120 and holes 122. When the two halves of connector 100 are installed on opposite sides of printed circuit board 102, pins 120 engage holes 122. Once aligned, the two halves of connector 100 are held together by rivets, screws or by any other convenient means.

Ground inserts 108 are formed with shoulders 132. When the two halves of connector 100 are pressed together, shoulders 132 form a slot for printed circuit board 102. Board 102 is inserted in the slot.

Housings 106 contain mounting tabs 110. Rivets 112 are placed through holes in mounting tab 110 and secure connector 100 to printed circuit board 102. Solder tails 126 of ground conductors 114 and signal conductors 116 are then soldered to printed circuit board 102.

The lower surface of housing 106 contains alignment pin 118. When connector 100 is mated to back plane 104, alignment pin 118 is inserted into hole 130. In this way, connector 100, and therefore signal contacts 116 and ground contacts 114 have a fixed relationship to the printed circuit traces on back plane 104.

Turning now to FIG. 2, further details of the construction of connector 100 may be seen. Each slot 212 terminates in a recess 210 in the lower surface of housing 106. Beams 128 of signal contacts 124 fit into recesses 210. Recesses 210 have a depth sufficient to receive beam portions 128 when connector 100 is pressed into back plane 104. In this way, signal contacts 116 are not permanently deformed when connector 100 is pressed against back plane 104. Rather, they act as springs.

Likewise, housing 106 has a spacer tab 216 which extends below ground insert 108. Spacer tab 216 prevents beam portions 128 of ground contacts 114 from being permanently deformed when connector 100 is pressed against a back plane 104.

Ground insert 108 contains tabs 222 projecting from its sides. Tabs 222 fit into slots 220 to ensure proper alignment of housing 106 and ground insert 108.

Signal contacts 116 are formed in pairs 230. Signal contacts 116 all have a transition region 232. The transition regions 232 of adjacent signal contacts 116 bend in opposite directions. Thus, for each pair 230, the solder tails 126 are closer together than beams 128. Beams 128 for all signal contacts 116 are evenly spaced, but there is more space between the solder tails 126 each pair 230 than between the solder tails for the contacts in the pair. Solder tails 126 for ground contact 114 fit into the space between adjacent pairs 230. Thus, for each pair 230 of signal contacts 116, there is one solder tail 126 for a ground contact 114.

Figure 3A:
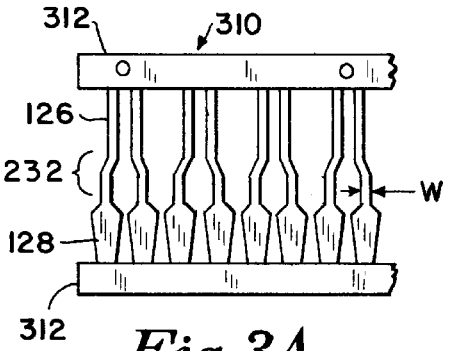
FIG. 3A is a sketch showing the signal contacts before assembly of the connector.

FIG. 3A shows signal contact blank 310 from which signal contacts 116 are formed. Preferably, numerous signal contacts 116 are stamped from a sheet of conductive metal. The metal should also be springy. A phosphor bronze is suitable, but other materials might also be used.

Following the stamping operation, the signal contacts 116 are left attached to bands 312 at each end of the sheet of conductive material. Bands 312 facilitate handling the signal contacts 116 so that they may be inserted into connector 100 as a unit rather than individually. Following insertion into connector 100, bands 312 are broken away to leave individual signal contacts 116. Score marks are included on the contact blanks to facilitate breaking away of bands 312.

Signal contacts 116 are formed from a flat sheet. Beams 128 are then bent as shown in FIGS. 1 and 2. Solder tails 126 are also bent as shown.

Figure 3B:
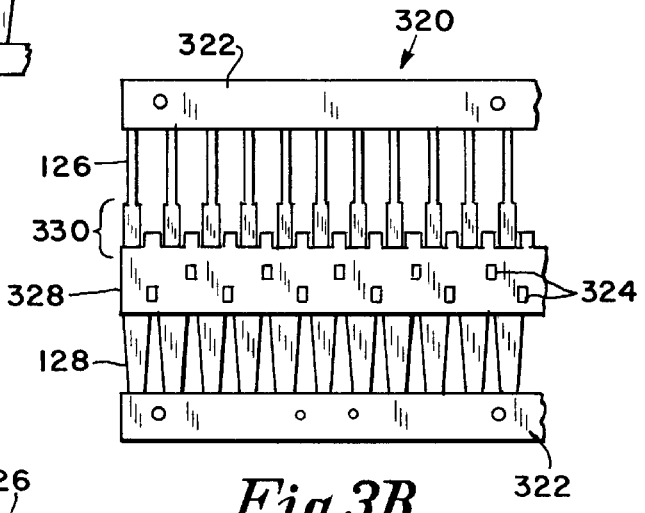
FIG. 3B is a sketch showing the ground contacts before assembly of the connector.

FIG. 3B shows ground contact blank 320. Preferably, blank 320 is stamped from a sheet of springy, conductive material, such as phosphor bronze. Following stamping, bands 322 remain and are used to facilitate handling, but are broken off before connector 100 is used.

Ground contact blank 320 is stamped to leave a ground sheet 328 in a central portion. Ground sheet 328 forms the ground plane of transmission line 124. It is embedded in ground insert 108. To facilitate firmly embedding ground contacts 114 during the injection molding operation, ground sheet 328 has several holes 324 cut in it to allow material to flow around it.

Figure 3C:
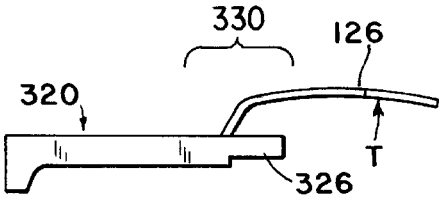
FIG. 3C is a sketch showing a side view of the ground contacts before assembly of the connector.

Ground blank 320 may optionally include a transition region 330. As shown in FIG. 1, ground contacts 114 and signal contacts 116 are separated by a distance T in transmission line region 124. However, as shown in FIG. 2, upper slots 214, into which solder tails 126 for both signal contacts 116 and ground contacts 114 are inserted, are aligned in a row. Thus, solder tails 126 of ground contacts 114 must be bent away from ground sheet 328 by a distance T. This bend is shown in FIG. 3C, which shows a side view of ground blank 320.

Transition region 330 of ground blank 320 also includes tabs 326. Tabs 326 20 provide a ground sheet for transmission line 124 in the transition region 232 of signal contacts 116.

In transition region 330, tails 126 of ground contacts 114 are wider than they are outside of transition region 330. This widening aids in reducing crosstalk between adjacent signal contacts.

Figure 4B:
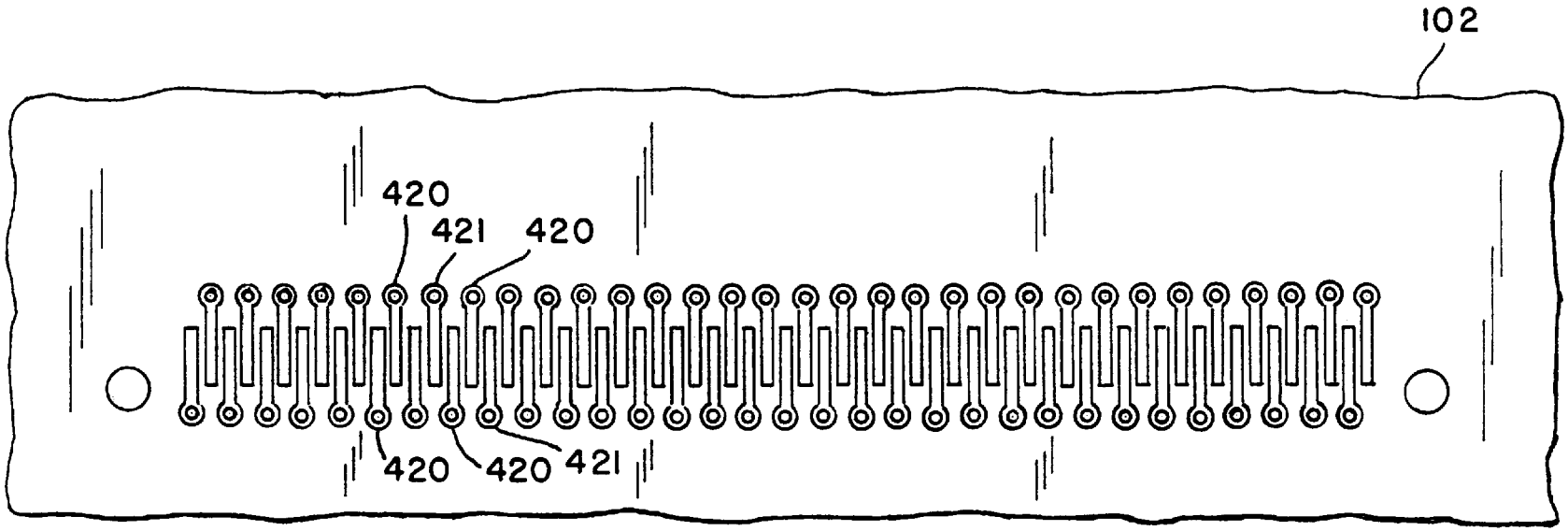
FIG. 4B is a sketch of the daughter card footprint.
Figure 4A:
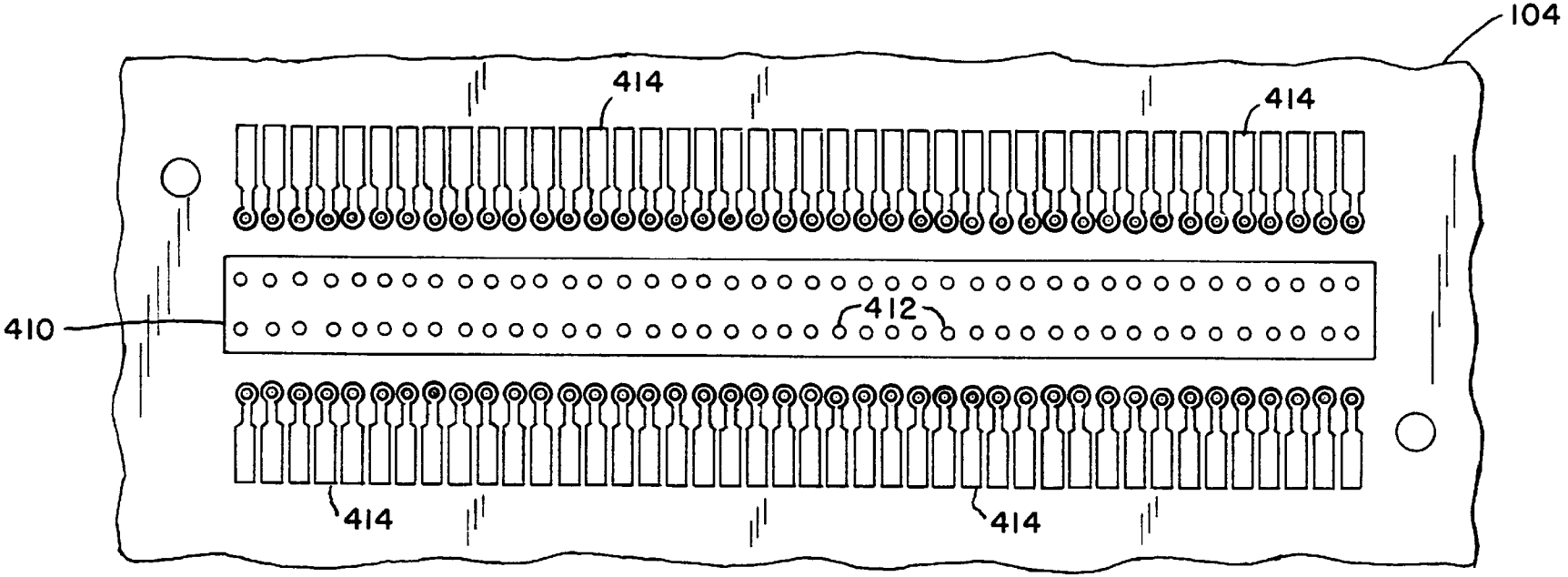
FIG. 4A is a sketch of the back plane footprint.

Turning now to FIG. 4A., a sketch of the contacts pads on back plane 104 is shown. The contact pads make up what is sometimes called the connector "footprint."

The center portion of the footprint is ground plane 410. Ground plane 410 is connected to ground circuitry (not shown) in back plane 104 through via holes 412, as is conventional in a multi-layer printed circuit board. Beam portion 128 of each of the ground contacts 114 presses against ground plane 410.

The beam portion 128 of each of the signal contacts 116 presses against a signal pad 414. Each signal pad 414 is connected to signal traces (not shown) within back plane 104, as is conventional in a multi-layer printed circuit board.

Alignment holes 130 ensure that connector 100 is positioned so that each of the signal contacts 116 presses against the appropriate signal pads 414. Each signal pad 414 is at least as wide as the beam portion 128 of the signal contacts 116. Preferably, the signal pad 414 are slightly wider to allow some tolerance in mating connector 100 to back plane 104.

FIG. 4B shows the foot print for printed circuit board 102. The solder tails 126 for ground contacts 114 are soldered to ground pads 421. The solder tails for signal contacts 116 are soldered to signal pads 420.

As described above in conjunction with FIG. 2, pairs 230 of signal contacts are separated by ground contacts. Thus, pairs of signal pads 420 are separated by a ground pad 421.

Ground pads 421 are connected with via holes to ground traces (not shown) within printed circuit board 102, as is conventional in a multi-layer printed circuit board. Likewise, signal pads 420 are connected to signal traces (not shown).

While connector 100 can be made any size, it provides the advantage of allowing relatively low cost manufacture of high speed and high density connectors. Transmission line section 124 may be designed to provide signal contacts with a desired characteristic impedance to avoid reflections of high speed signals. The spacing T (FIG. 1) as well as the width W (FIG. 3A) of the signal contacts 116 can be adjusted to control the characteristic impedance of the transmission line section 124. The dielectric constant of the material used to make ground insert 108 may also altered as can the thickness of the signal contacts 116 to change the characteristic impedance.

Connector 100 should transmit signals from back plane signal pads 414 to signal pads 420 on printed circuit board 102 with as little distortion as possible. To reduce distortion, solder tails 126 on signal contacts 116 should be kept as short as possible. Solder tails 126 are preferably only as long as needed to facilitate soldering.

Likewise, beams 128 should preferably be as short as possible. However, beams 128 should be long enough to form good springs.

In a preferred embodiment, connector 100 is mounted to a daughter card 102 and backplane 104 is made as part of a card cage system. A card cage system has guide rails for daughter cards to ensure that they are appropriately aligned with connectors on the backplane. A typical daughter card used in a card cage assembly has locking levers to hold it in place. A locking lever arrangement can be used to generate the required force to press connector 100 against backplane 104. However, jack screws between the daughter card and the card cage is the preferred method of attachment. Jack screws can be adjusted to generate the required force independent of manufacturing tolerances on the printed circuit boards.

Example

If a connector is made according to the invention with the dimensions given below, spice simulations indicate that the connector will have an edge rate degradation of 258 ps for an input signal with a rise time of 258 ps. It will have 70 mV of crosstalk when five signal lines are driven simultaneously with an input signal with a 250 ps rise time and one undriven line is monitored. The characteristic impedance will be 59•.

The following parameters were used: spacing T of 0.016 inches; width W of 0.017 inches. The relative dielectric of the housing was 3.1. Signal contacts 116 were 0.0075 inches thick. Solder tails 126 were approximately 0.1 inches long and 0.012 inches wide. Signal contacts within transmission line region 124 were 0.15 inches long. Beam portions 128 had an overall length of 0.13 inches. They expanded to a maximum dimension of 0.022 inches and tapered at their end to a minimum dimension of 0.012 inches. The taper provided a constant spring force as opposed to a spring force linearly related to displacement.

Having described one embodiment, numerous alternative embodiments or variations might be made. For example, the exact materials used could be varied. Also, the dimensions given above are representative and could be varied. The impedance of the connector can be varied by varying these elements.

Further, it was mentioned that spring beams 128 of the signal contact increase the inductance of the connector. Where it is desirable to reduce the inductance of the connector, those beams might be shortened. If it is desirable to reduce the inductance even further, it would be possible to insert grounded metal in housing 106 above and generally parallel with spring beams 128. Such a grounded metal insert might, for example, be formed by injection molding in the same way that 328 is injection molded inside 108. The plate could be similarly grounded by spring beams making contact with ground pad 412.

As another example of a possible variation, it was mentioned that each of the signal and ground contacts has a solder tail which is attached to the daughter board 102. Other forms of attachment might be used, such as press fit tails or tails soldered in through holes. Alternatively, solder tails 126 might be replaced with spring beam type contacts to facilitate spring type attachment at both sides of the connector. Such an arrangement might be useful for what is known as a mezzanine type connector.

Even with the shown arrangement, it is not necessary that daughter board 102 be perpendicular to backplane 104. For example, if daughter card 102 is mounted parallel to backplane 102, solder tails 126 can be bent to make contact.

Further, it was mentioned that ground contacts are injection molded into a portion of the housing and that the signal contacts were laid into grooves in the housing. The signal contacts could be injection molded into the housing and the ground contacts could be placed between pieces of the housing. As another variation, both the ground contacts and the signal contacts could be injected molded into the housing. In a still further variation, neither might be injection molded. In this latter arrangement, spacers to keep the signal and ground contacts apart might be molded into the housing or placed in as a separate piece.

Further, it was described that the ground contacts shared a plate 328 which is positioned adjacent each of the signal contacts to form a transmission line. It is not necessary that all of the ground contacts be joined to a common plate. A separate ground contact could be configured to run beside each signal contact.

Also, it is not necessary that there be one ground contact for every two signal contacts. While this arrangement provides good grounding, the fact that all of the ground contacts are connected to plate 328 means that more or fewer ground contacts can be used. It is also not necessary that transition region 330 include widened portions for tails 126 of the ground contacts or tabs 326. Such structures control the impedance and reduce crosstalk, but may not be necessary in all cases.

It should also be noted that the construction of connector 100 facilitates its use in what is termed an "active connector." The signal contacts 116 face the outer surface of housing 106. If a cavity is formed in housing 106, it will expose connectors 116. Connectors 116 will appear on the floor of the cavity like traces on a printed circuit board. A circuit module, such as might be mounted to a printed circuit board could then be mounted in the cavity. If necessary, the connectors 116 can be interrupted, leaving two ends exposed in the cavity. In this case, a signal might be passed from the backplane into an active surface element for processing. The processed signal would then be coupled to the other exposed end of the signal connector, resulting in a processed signal being passed to the daughter card. Filters and amplifiers are two examples of the types of circuit elements which might be inserted in such a cavity, but any circuit element might be used.

Moreover, the footprints shown in FIG. 4 should be viewed as illustrative. FIG. 4A shows that via holes on contact pads 414 face ground pad 410. If the via holes for the contact pads were placed away from ground pad 410, ground pad 410 could be made larger. A larger ground pad might further reduce cross talk or the capacitance of the connector and would be desirable in some cases. Likewise, FIG. 4B shows one possible layout of contact pads. Other arrangements which might be easier to manufacture depending on the specific process used to fabricate daughter cards are possible.

Therefore, the invention should be limited only by the spirit and scope of the appended claims.

What is claimed is:

1. An electrical connector including a plurality of subassemblies aligned in parallel, each subassembly comprising:

a ground plate;

a plurality of signal contacts; and an insulative housing having a first portion and a separate second portion attached to the first portion, the first portion having a plurality of slots formed therein, wherein the second portion of the insulative housings molded over a portion of the ground plate, and wherein one of the plurality of signal contacts is disposed in each of the slots.

2. The electrical connector of claim 1, wherein the signal contacts in each of the subassemblies are disposed in pairs with the distance between signal contacts within a pair being less than the distance between signal contacts in different pairs.

3. The electrical connector of claim 1, wherein the signal contacts include beam portions, and wherein the ground plate includes beam portions.

4. The electrical connector of claim 3, wherein the distance between adjacent beam portions of the signal contacts and the distance between adjacent beam portions of the ground plate are uniform.

5. The electrical connector of claim 1, wherein the ground plate forms the ground plane of a transmission line.

6. The electrical connector of claim 1, wherein the signal contacts include tail portions extending in parallel from the first portion of the insulative housing, and wherein the ground plate includes a plurality of tail portions extending from the second portion of the insulative housing in parallel with the tail portions of the signal contacts.

7. The electrical connector of claim 6, wherein adjacent tail portions of the ground plate have at least one tail portion of a signal contact disposed therebetween.

8. The electrical connector of claim 7, wherein the at least one tail portion of a signal contact disposed between adjacent tail portions of the ground plate consists of two tail portions of the signal contacts.

9. The electrical connector of claim 3, wherein the beam portions of the ground plate and the signal contacts make electrical contact with contact pads on a backplane.

10. The electrical connector of claim 6, wherein the tail portions of the ground plate and the signal contacts make electrical contact with contact pads on a daughter board.

11. A backplane assembly incorporating the connector of claim 1, further including a backplane, and a daughter card, wherein the plurality of subassemblies is attached to the daughter card, wherein the ground plate and the signal contacts have tail portions for making electrical contact with contact pads on the daughter card, and wherein the ground plate and the signal contacts have beam portions for making electrical contact with contact pads on the backplane.

12. The backplane assembly of claim 11, wherein the beam portions of the ground plate and the signal contacts make electrical contact with the backplane by spring force generated in the beam portions.

13. An electrical connector including a plurality of subassemblies aligned in parallel, each subassembly comprising:

a plate;

a plurality of signal contacts; and an insulative housing, wherein a portion of the insulative housing is molded over a portion of the plate, wherein a portion of the insulative housing has a plurality of slots and each of the signal contacts is inserted in one of the slots, and wherein the two portions of the insulative housing are adapted to engage each other.

14. The electrical connector of claim 13, wherein a portion of the plate is in parallel with the signal contacts inserted in the cavities.

15. The electrical connector of claim 13, wherein the plate is a uniform distance from the signal contacts.

16. The electrical connector of claim 13, wherein the plurality of subassemblies is attached to a daughter card.

17. The electrical connector of claim 16, wherein the plate and the signal contacts include tail portions for making electrical contact with the daughter card, and wherein the plate and the signal contacts include end portions for making a separable electrical contact with contacts connected to a backplane.

18. The electrical connector of claim 17, wherein the end portions of the plate and the signal contacts make electrical contact with pads on the backplane by spring force generated in the beam portions.

19. An electrical connector comprising a plurality of subassemblies, each subassembly comprising:

a) a plurality of signal contacts;

b) a ground plate;

c) an insulative housing having a first portion and a second portion separable from and connected to the first portion, wherein the first portion is molded over the ground plate and one of the first portion and the second portions has slots disposed therein and wherein a portion of each of the signal contacts is contained within the slots.

20. The electrical connector of claim 19, wherein the subassemblies consist of two subassemblies, the subassemblies being attached to a daughter card.

21. The electrical connector of claim 20, wherein the plate and the signal contacts include tail portions for making electrical contact with the daughter card.

22. The electrical connector of claim 21, wherein each signal contacts includes an end portion for making a separable electrical connection.

23. The electrical connector of claim 22, wherein the end portions of the signal contacts make contact with the backplane by spring force generated in the end portions.

24. The electrical connector of claim 19, wherein the signal contacts in each of the subassemblies are disposed in pairs with the distance between signal contacts within a pair being less than the distance between signal contacts in different pairs.

25. The electrical connector of claim 19, wherein the signal contacts include beam portions, and wherein the ground plate includes beam portions.

26. The electrical connector of claim 19, wherein the ground plate forms the ground plane of a transmission line.

27. The electrical connector of claim 19, wherein the signal contacts include tail portions extending in parallel from the first portion of the insulative housing, and wherein the ground plate includes a plurality of tail portions extending from the second portion of the insulative housing in parallel with the tail portions of the signal contacts.

28. The electrical connector of claim 27, wherein the tail portions of the ground plate and the signal contacts are compliant beams making electrical contact with contact pads on a backplane.

29. A backplane assembly incorporating the connector of claim 19, further including a backplane, and a daughter card, wherein the plurality of subassemblies is attached in parallel to the daughter card, wherein the ground plate and the signal contacts have tail portions for making electrical contact with contact pads on the daughter card, and wherein the ground plate and the signal contacts have beam portions for making electrical contact with contact pads on the backplane.

30. The electrical connector of claim 19 wherein the plurality of subassemblies are aligned in parallel.

31. The electrical connector of claim 19 wherein, within each subassembly, the ground plate is parallel to the plurality of signal contacts over a substantial length.

* * * * *